US007866011B2

(12) United States Patent
Greco et al.

(10) Patent No.: US 7,866,011 B2
(45) Date of Patent: Jan. 11, 2011

(54) ZIPPER WITH FOLD OVER ELEMENTS FOR RECLOSABLE PACKAGE

(75) Inventors: Charles Greco, Bardonia, NY (US); Rusty Koenigkramer, Nanuet, NY (US); David J. Anzini, Middletown, NY (US)

(73) Assignee: Illinois Tool Works Inc., Glenview, IL (US)

( * ) Notice: Subject to any disclaimer, the term of this patent is extended or adjusted under 35 U.S.C. 154(b) by 768 days.

(21) Appl. No.: 11/796,446

(22) Filed: Apr. 27, 2007

(65) Prior Publication Data

US 2008/0267542 A1 Oct. 30, 2008

(51) Int. Cl.
*B65D 33/25* (2006.01)
*B65D 33/18* (2006.01)

(52) U.S. Cl. ..... 24/399; 24/400; 383/61.2; 383/61.3; 383/210.1

(58) Field of Classification Search ..... 383/61.2, 383/61.3, 63, 64, 210.1; 24/399, 400, 304, 24/DIG. 11, 585.12, DIG. 50
See application file for complete search history.

(56) References Cited

U.S. PATENT DOCUMENTS 4,637,063 A 1/1987 Sullivan et al.
5,509,735 A 4/1996 May
6,354,738 B1 3/2002 Buckman et al.
6,979,482 B2 12/2005 Hartzell
7,090,904 B2 8/2006 Hartzell et al.

FOREIGN PATENT DOCUMENTS

EP 1 642 839 4/2006
EP 1642839 A1 * 4/2006
EP 1 702 858 9/2006
EP 1702858 A1 * 9/2006

* cited by examiner

*Primary Examiner*—Robert J Sandy
(74) *Attorney, Agent, or Firm*—Day Pitney LLP

(57) ABSTRACT

A zipper assembly for a reclosable package or bag is disclosed. The zipper assembly includes two profiles with flanges and internal interlocking elements on the interior of the flanges. The exterior of one of the flanges includes two exterior parallel press-to-close profile-like interlocking elements which are brought into engagement with each other by folding the flanges of the zipper assembly. This increases the burst handling capability of the zipper assembly and the package or bag to which it is attached. Alternatives include substituting a peel seal for the exterior interlocking element as well as an exterior label or sticker to maintain the flanges in a folded configuration.

18 Claims, 4 Drawing Sheets

ZIPPER WITH FOLD OVER ELEMENTS FOR RECLOSABLE PACKAGE

BACKGROUND OF THE INVENTION

1. Field of the Invention

The present invention relates to a zipper for reclosable packages or bags, wherein the zipper is secured in a folded over configuration to achieve a high burst strength for the package or bag. This can be achieved with secondary zipper profiles formed on an exterior face of one of the flanges, allowing the zipper to be folded over thereby interlocking the exterior profiles. Additionally, a peel seal or an adhesive label can be used to secure the zipper in a folded over configuration.

2. Description of the Prior Art

Large packages, bags or pouches, such as those used for pet food, charcoal, cat litter and similar items are typically filled and sealed shut, with no reclosure mechanism. These packages may be formed by form fill and seal (FFS) or by other methods. Prior attempts to incorporate a zipper reclosure mechanism have been unsatisfactory due to the unique requirements of a large bag with a relatively heavy load. In particular, filling from the bottom places all of the load on the reclosure during filling. This load can cause the zipper reclosure to fail and open. Similarly, dropping a filled bag onto a pallet or similar rough handling during transportation, as well as exposing a bag to elevated temperatures during transportation, can cause the zipper reclosure to fail.

The prior art has addressed these deficiencies by folding over the end of the package, particularly a multi-wall package, using an expensive label as tape thereby allowing successful filling and transport. Similarly, the prior art has addressed these deficiencies by using a liner peel seal below the zipper and a solid tear line in the zipper flange to provide a fill and transport system that does not rupture and spill the contents. However, these methods have slow rates of production, as well as increased costs of production, and frequently do not result in a satisfactory product for the consumer.

Some further examples of the prior art which are not entirely satisfactory are found in U.S. Pat. No. 6,979,482 entitled "Multiwall Bag with Zipper and Fin" issued on Dec. 27, 2005 to Hartzell et al. and U.S. Pat. No. 7,090,904 entitled "Enhanced Slider Zipper Multiwall Bag and Associated Methods" issued On Aug. 15, 2006 to Hartzell et al.

Typical prior tamper-evident zipper assemblies are disclosed in U.S. Pat. No. 6,354,738 entitled "Tamper Evident Reclosable Plastic Bag" issued on Mar. 12, 2002 to Buckman et al.; U.S. Pat. No. 4,637,063 entitled "Reclosable Bag with Sealed Laminated Liner and Method" issued on Jan. 13, 1987 to Sullivan; and U.S. Pat. No. 5,509,735 entitled "Closure Arrangement Having a Peelable Seal" issued on Apr. 23, 1996 to May.

OBJECTS AND SUMMARY OF THE INVENTION

It is therefore an object of the present invention to provide a zipper for reclosable packages, particularly large bags to provide increased burst strengths while maintaining the capacity of the large bag and further maintaining ease of opening by the consumer.

It is therefore a further object of the present invention to provide a zipper for reclosable packages which is adaptable to standard zipper profiles, is applicable to a wide range of package materials and further provides for clip protection of the contents of the package or bag.

These and other objects are attained by providing a zipper assembly, with either a slider zipper or a press-to-close zipper, with flanges which are secured to the exterior of the reclosable package or bag. The exterior face of one of the flanges includes first and second exterior profiles. This allows the interlocked zipper to be folded over so that the first and second exterior profiles can interlock with each other. This provides for increased zipper strength by reducing the effect of internal forces or shocks on the primary interlocking profiles of the zipper. This strength can be further increased by providing clips to secure the zipper in the folded over configuration.

Alternative embodiments use a pre-applied post-activation peel seal or an adhesive label in place of the exterior profiles.

DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENTS

Figure 1:
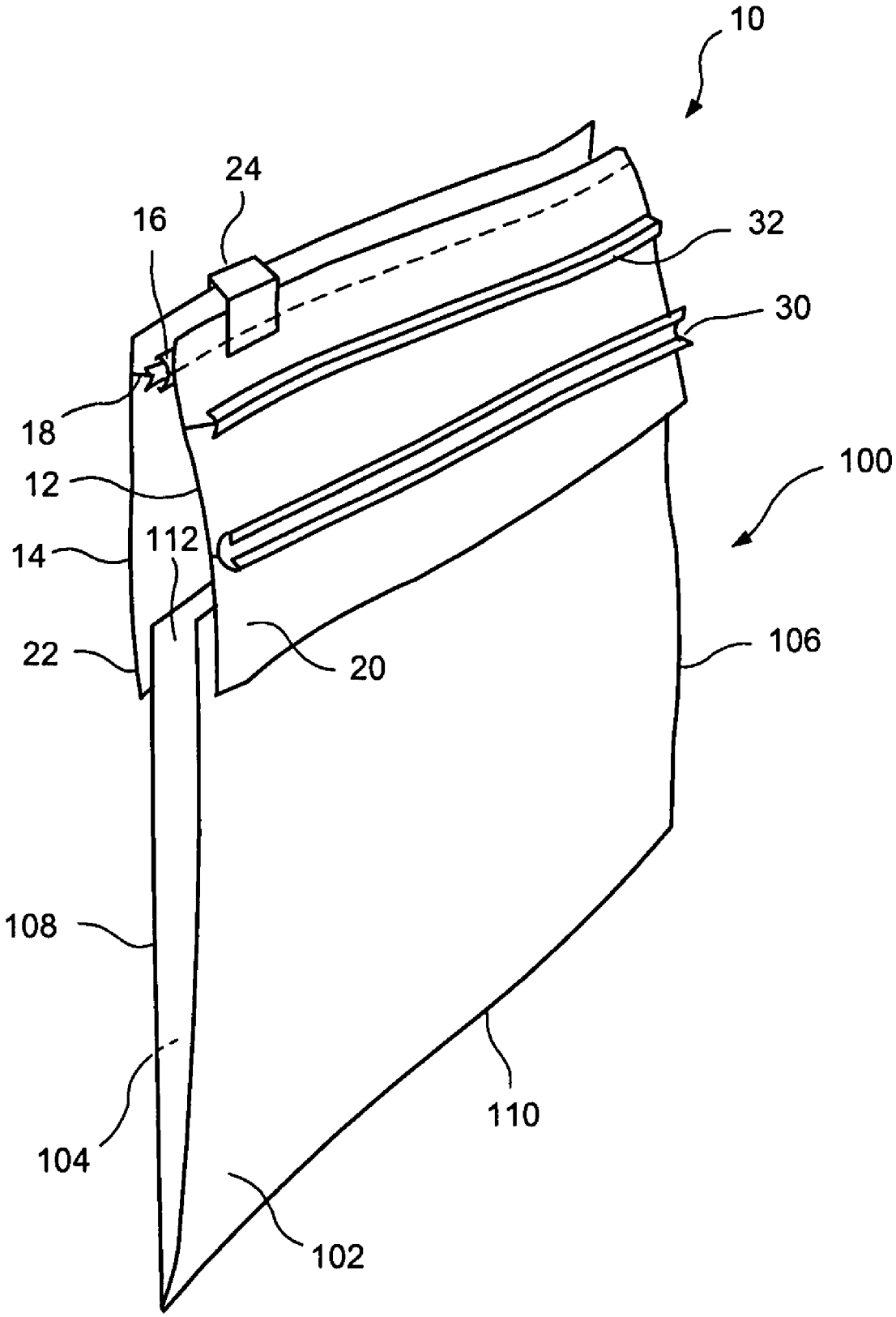
FIG. 1 is a perspective, partially exploded and partially in phantom, view of a reclosable package or bag including the zipper assembly of the present invention in an unfolded configuration.
Figure 2:
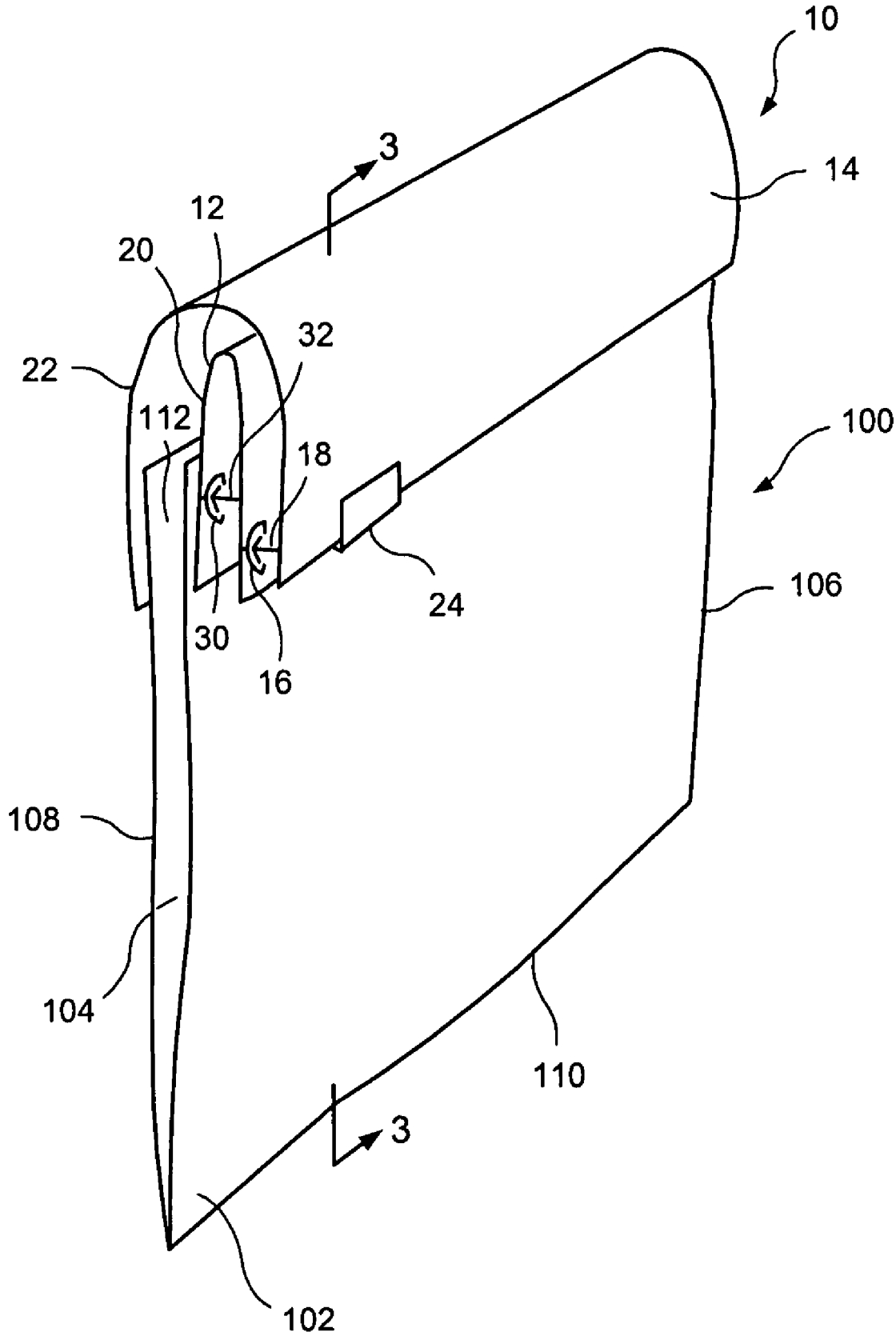
FIG. 2 is a perspective, partially exploded, view of a reclosable package or bag including the zipper assembly of the present invention in a folded configuration.

Referring now to the drawings in detail wherein like numerals indicate like elements throughout the several views, one sees that FIG. 1 is a perspective, partially exploded, partially in phantom, view of package or bag 100 with the zipper assembly 10 in the unfolded configuration. Likewise, FIG. 2 is a perspective, partially exploded view of package or bag 100 with the zipper assembly 10 in the folded configuration. Package 100 is formed from coextensive front wall 102 and rear wall 104, typically formed of polymeric material, polypropylene woven material or multi-wall paper. Those skilled in the art will recognize a wide range of equivalents after review of this disclosure. Side seal 106 is formed between the right (from the perspective of FIGS. 1 and 2) edges of front wall 102 and rear wall 104. Side seal 108 is likewise formed between the left edges of front wall 102 and rear wall 104, but FIGS. 1 and 2 illustrate the walls 102, 104 in a slightly separated or exploded configuration for ease of illustration and explanation. Likewise, the bottom edges of front wall 102 and rear wall 104 are sealed together at bottom seal 110. Mouth 112 is formed between the upper edges of front wall 102 and rear wall 104. While not illustrated, it is envisioned that gussets could be formed between the front and rear walls 102, 104.

Zipper assembly 10 includes first profile 12 and second profile 14. First profile 12 includes first interior interlocking element 16 (illustrated as a female interlocking element) and first flange 20. First interlocking element 16 is formed on the interior of the distal end of first profile 12. Second profile 14 includes second interior interlocking element 18 (illustrated as a male interlocking element) and second flange 22. The female and male characteristics of the first and second interior interlocking elements 16, 18 can be reversed or other interlocking configurations can be used. Second interlocking element 18 is formed on the interior of the distal end of second profile 14. The phantom line near the top of FIG. 1 is to illustrate that the first and second interlocking elements 16, 20 extend along the entire width of first and second flanges 18, 22, respectively.

The proximal end of first flange 20 is sealed to the exterior of front wall 102 proximate to mouth 112 while the proximal end of second flange 22 is sealed to the exterior of rear wall 104 proximate to mouth 112. Optional slider 24 is mounted on distal ends of first and second flanges 20, 22 and operates in the conventional manner of separating first and second interior interlocking elements 16, 18 when moved in an opening direction and interlocking first and second interlocking elements 16, 18 when moved in a closing direction.

Figure 3:
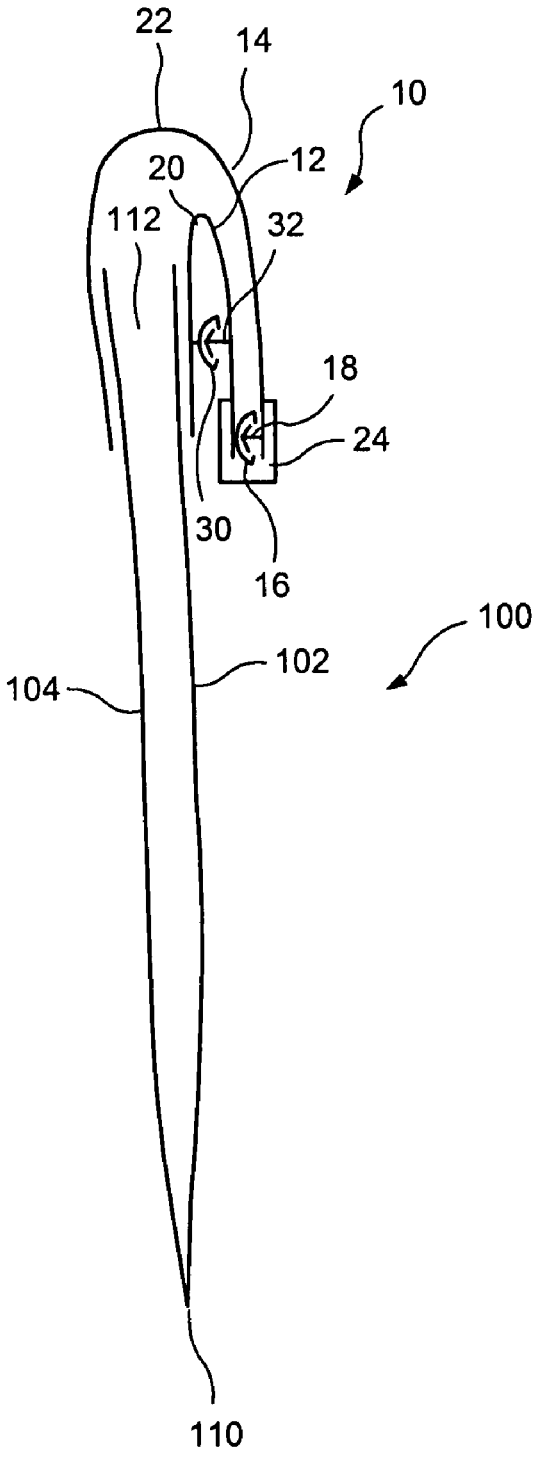
FIG. 3 is a cross-sectional view along plane 3-3 of FIG. 2, showing the exterior secondary zipper profiles.

First exterior interlocking element or profile 30 (illustrated in FIGS. 1-3 as a female element) and second exterior interlocking element or profile 32 (illustrated in FIGS. 1-3 as a male element) extend in spaced parallel configuration across the entire width of the exterior of first flange 20. First and second exterior interlocking elements or profiles 30, 32 typically are press-to-close elements. The female and male characteristics of the first and second exterior interlocking elements 30, 32 can be reversed or other interlocking configurations can be used. As shown in FIG. 2, first and second flanges 20, 22 can be folded so as to bring first and second exterior interlocking elements 30, 32 into interlocking engagement thereby increasing the burst handling capability of zipper assembly 10.

By maintaining the zipper assembly 10, rather than the walls 102, 104 of package or bag 100, in a folded configuration, the burst handling capabilities are increased without decreasing the capacity of package or bag 100.

Figure 4:
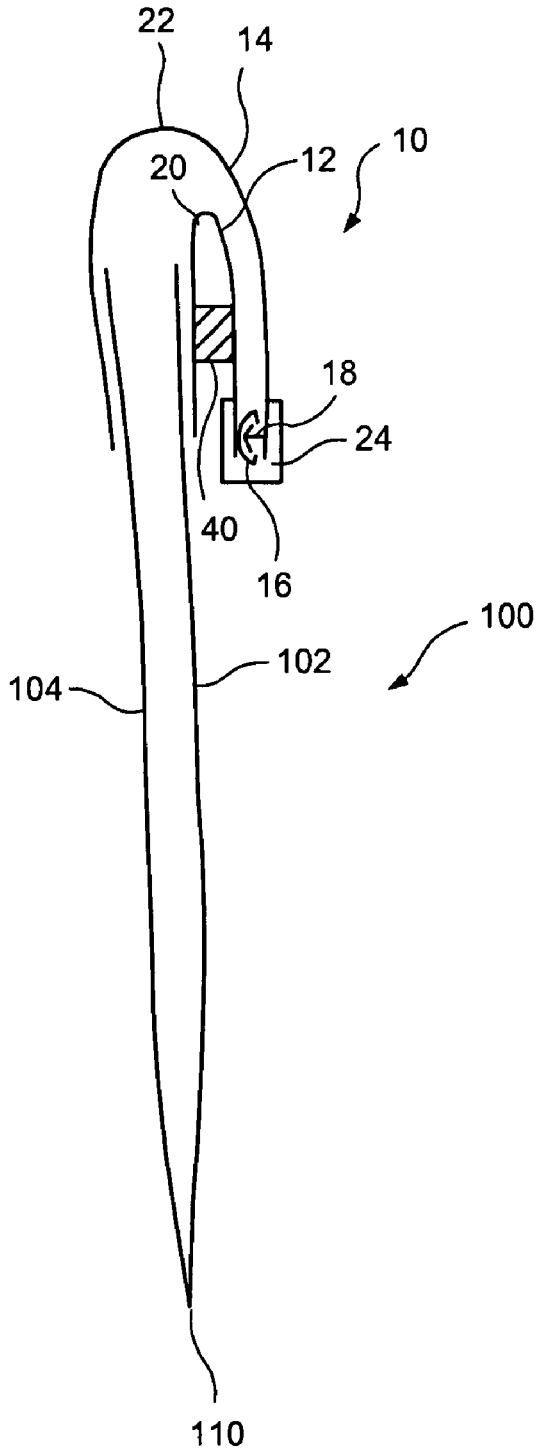
FIG. 4 is a cross-sectional view along plane 3-3 of FIG. 2, showing an alternative embodiment with a peel seal in place of the exterior secondary zipper profiles.

The alternative embodiment of FIG. 4 substitutes peel seal 40 (typically a pre-applied post-activation peel seal) for first and second exterior interlocking elements 30, 32, thereby providing tamper evidence. Peel seal 40 typically extends across the entire width of first flange 12, with a first portion of first flange 12 being engaged by a first side of peel seal 40 and a second portion (in spaced parallel relation to the first portion) of first flange 12 being engaged by a second side of peel seal 40 thereby maintaining the folded configuration.

Figure 5:
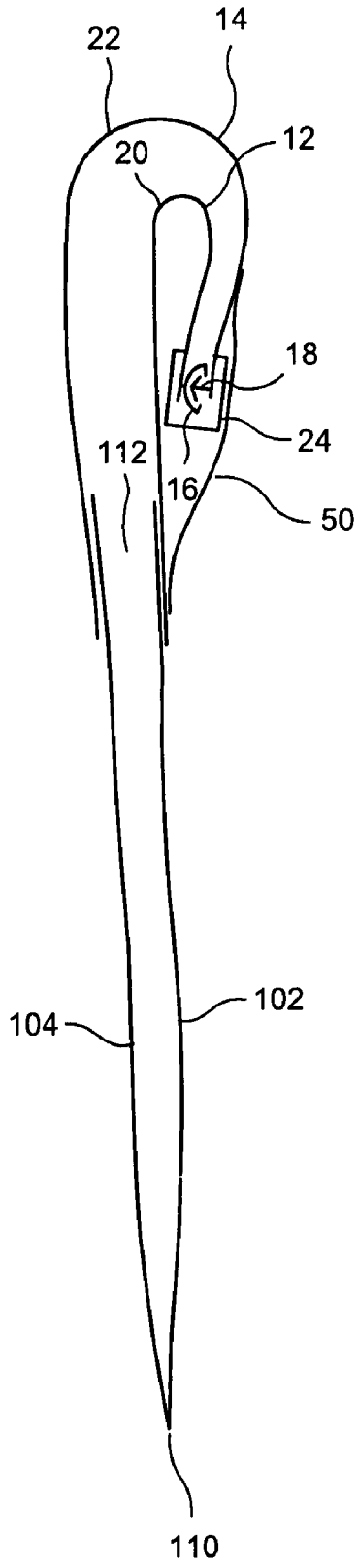
FIG. 5 is a cross-sectional view along plane 3-3 of FIG. 2, showing a further alternative embodiment wherein the folded over configuration of the zipper is maintained by an adhesive tape label.

The second alternative embodiment of FIG. 5 substitutes an exterior adhesive label or sticker 50 for first and second exterior interlocking elements 30, 32 in order to maintain the zipper assembly 10 in a folded configuration with first flange 20 folded against itself and second flange 22 folded thereover. A first or lower end of the adhesive label or sticker 50 contacts the first flange 12 of zipper assembly 10 while a second or upper end of the adhesive label or sticker 50 contacts the second flange 14.

Moreover, the elements of the various embodiments can be used in combination with each other.

Additionally, any of these embodiments in the folded configuration are highly adaptable to the use of clips (not shown) over the folded zipper assembly 10 to further increase burst strength of the packages or bags.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A zipper assembly for a reclosable package or bag, comprising:

a first profile including a first flange and a first interior interlocking element;

a second profile including a second flange and a second interior interlocking element; and the first flange further including a first exterior interlocking element and a second exterior interlocking element, whereby the first and second flanges can be folded to bring the first and second exterior interlocking elements into interlocking configuration with each other.

2. The zipper assembly of claim 1 wherein the first interior interlocking element is formed on an interior face of the first profile and the second interior interlocking element is formed on an interior face of the second profile.

3. The zipper assembly of claim 2 wherein the first exterior interlocking element and the second interlocking element are formed in spaced parallel relationship to each other.

4. The zipper assembly of claim 3 wherein the first exterior interlocking element and the second interlocking element extend across the entire width of the first flange.

5. The zipper assembly of claim 4 wherein one of the first and second exterior interlocking elements is a male element and another of the first and second exterior interlocking elements is a female element.

6. The zipper assembly of claim 2 wherein the first and second exterior interlocking elements are profiles with a press-to-close configuration.

7. The zipper assembly of claim 2 wherein the first interior interlocking element and the second interlocking element extend across the entire width of the first and second profiles.

8. The zipper assembly of claim 1 wherein one of the first and second interior interlocking elements is a male element and another of the first and second interior interlocking elements is a female element.

9. The zipper assembly of claim 8 further including a slider for separating the first and second interior interlocking elements when moved in an opening direction and for interlocking the first and second interior interlocking elements when moved in a closing direction.

10. The zipper assembly of claim 1 wherein the first and second flanges are arranged and configured for attachment to walls of a reclosable package or bag.

11. A zipper assembly for a reclosable package or bag, comprising:

a first profile including a first flange and a first interior interlocking element;

a second profile including a second flange and a second interior interlocking element; and the first flange further including an exterior peel seal, whereby the first and second flanges can be folded to bring the peel seal into sealing contact with two portions of the first flange.

12. The zipper assembly of claim 11 wherein a first side of the peel seal is attached to a first portion of the first flange and the first and second flanges are folded to bring a second portion of the first flange into contact with a second side of the peel seal.

13. The zipper assembly of claim 12 wherein the first and second portions of the first flange extend across the entire width of the first flange.

14. The zipper assembly of claim 13 wherein the first and second portions of the first flange are in spaced parallel relationship to each other.

15. The zipper assembly of claim 11 wherein the first interior interlocking element and the second interior interlocking element extend across the entire width of the first and second profiles.

16. The zipper assembly of claim 15 wherein one of the first and second interior interlocking elements is a male element and another of the first and second interior interlocking elements is a female element.

17. The zipper assembly of claim 11 further including a slider for separating the first and second interior interlocking elements when moved in an opening direction and for interlocking the first and second interior interlocking elements when moved in a closing direction.

18. The zipper assembly of claim 11 wherein the first and second flanges are arranged and configured for attachment to walls of a reclosable package or bag.

* * * * *